US009601076B2

(12) United States Patent
Kim et al.

(10) Patent No.: US 9,601,076 B2
(45) Date of Patent: Mar. 21, 2017

(54) SOURCE DRIVER THAT GENERATES FROM IMAGE DATA AN INTERPOLATED OUTPUT SIGNAL FOR USE BY A FLAT PANEL DISPLAY AND METHODS THEREOF

(75) Inventors: Hyung-tae Kim, Gyeonggi-do (KR); Woo-nyoung Lee, Gyeonggi-do (KR)

(73) Assignee: SAMSUNG ELECTRONICS CO., LTD., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 2448 days.

(21) Appl. No.: 12/400,222

(22) Filed: Mar. 9, 2009

(65) Prior Publication Data

US 2009/0174645 A1 Jul. 9, 2009

Related U.S. Application Data

(63) Continuation of application No. 11/258,471, filed on Oct. 25, 2005, now Pat. No. 7,511,694.

(30) Foreign Application Priority Data

Oct. 28, 2004 (KR) ..... 10-2004-0086560

(51) Int. Cl.
*G09G 3/36* (2006.01)

(52) U.S. Cl.
CPC ..... *G09G 3/3688* (2013.01); *G09G 2310/027* (2013.01); *G09G 2310/0291* (2013.01); *G09G 2320/0276* (2013.01)

(58) Field of Classification Search
CPC ..... G09G 2310/027; G09G 2310/0291; G09G 2320/0276

(Continued)

(56) References Cited

U.S. PATENT DOCUMENTS 5,773,873 A 6/1998 Kuriyama
6,469,647 B1 10/2002 Kinugasa et al.
(Continued)

FOREIGN PATENT DOCUMENTS

JP 7-283666 A 10/1995
JP 8-102628 A 4/1996
JP 08-250940 A 9/1996

*Primary Examiner* — William Boddie
*Assistant Examiner* — Leonid Shapiro
(74) *Attorney, Agent, or Firm* — Muir Patent Law, PLLC

(57) ABSTRACT

A source driver that responds to image data by generating an output signal which can be used to drive a flat panel display. The source driver includes a gamma decoder and an amplifier. The gamma decoder selects a first voltage among first analog gray voltages based on some upper bits of the image data, selects a second voltage among second analog gray voltages based on other upper bits of the image data, and selectively outputs at least one of the first and second voltages as a plurality of distributed analog signals in response to lower bits of the image data. The amplifier interpolates between the distributed analog signals from the gamma decoder to generate the output signal of the source driver. The amplifier includes bias circuits that are each configured to generate a bias current, and a plurality of MOSFETs. Each of the MOSFETs includes a source, a drain, and a gate terminal. The gate terminal of each of the MOSFETS is separately connected to receive a different one of the distributed analog signals from the gamma decoder. One of the source/drain terminals of each of the MOSFETS is separately connected to a different one of the bias circuits to receive the bias current, and the other one of the source/drain terminals of each of the MOSFETS is connected together at an output node to generate an interpolated signal. The output signal is based on the interpolated signal.

36 Claims, 6 Drawing Sheets

(58) Field of Classification Search
USPC ..... 345/89, 99–100, 204, 690
See application file for complete search history.

(56) References Cited

U.S. PATENT DOCUMENTS

| | | | | |
|---|---|---|---|---|
| 2005/0088329 | A1 | 4/2005 | Tsuchi | |
| 2007/0091052 | A1* | 4/2007 | Tsuchi | 345/100 |

* cited by examiner

| D[9]~D[3] | D[2] | D[1] | D[0] | DECODER OUTPUT | A, B, C, D | OUT |
|---|---|---|---|---|---|---|
| XXXXXXX | 0 | 0 | 0 | V1, V2 | V1, V1 ,V1, V1 | V1 |
| XXXXXXX | 0 | 0 | 1 | | V1, V1, V1, V2 | (3V1+V2)/4 |
| XXXXXXX | 0 | 1 | 0 | | V1, V1, V2, V2 | (2V1+2V2)/4 |
| XXXXXXX | 0 | 1 | 1 | | V1, V2, V2, V2 | (V1+3V2)/4 |
| XXXXXXX | 1 | 0 | 0 | | V2, V2, V2, V2 | V2 |

| D[9]~D[2] | D[1] | D[0] | DECODER OUTPUT | A, B | OUT |
|---|---|---|---|---|---|
| XXXXXXXX | 0 | 0 | V1, V2 | V1, V1 | V1 |
| XXXXXXXX | 0 | 1 | | V1, V2 | (V1+V2)/2 |
| XXXXXXXX | 1 | 0 | | V2, V2 | V2 |

SOURCE DRIVER THAT GENERATES FROM IMAGE DATA AN INTERPOLATED OUTPUT SIGNAL FOR USE BY A FLAT PANEL DISPLAY AND METHODS THEREOF

PRIORITY STATEMENT

This U.S. non-provisional patent application is a continuation of U.S. patent application Ser. No. 11/258,471, filed Oct. 25, 2005, now U.S. Pat. No. 7,511,694 and claims priority under 35 U.S.C. §119 to Korean Patent Application No. 10-2004-0086560, filed on Oct. 28, 2004 in the Korean Intellectual Property Office, the disclosure of which is incorporated herein in its entirety by reference.

FIELD OF THE INVENTION

The present invention relates to flat panel display devices and, more particularly, to source drivers for driving source lines of flat panel display devices.

BACKGROUND OF THE INVENTION

Some types of flat panel display devices are TFT-LCDs (Thin Film Transistor-Liquid Crystal Displays), EL (Electro Luminance) displays, STN (Super Twisted Nematic)-LCDs, and PDPs (Plasma Display Panels).

FIG. 1 is a block diagram of a conventional TFT-LCD 100 that includes a TFT-LCD panel 110 and peripheral circuits. The TFT-LCD panel 110 includes an upper plate and a lower plate, each including a plurality of electrodes for forming electric fields, a liquid crystal layer between the upper and lower plates, and polarization plates for polarizing light which are respectively attached to the upper and lower plates. The brightness of light that is transmitted through the TFT-LCD 100 is controlled by applying corresponding voltages (gray voltages) to pixel electrodes to re-arrange liquid crystal polymers in the liquid crystal layer and cause various gray levels. To apply the gray voltages to the pixel electrodes, a plurality of switching devices, such as TFTs, connected to the pixel electrodes are located on the lower plate of the TFT-LCD panel 110. The switching devices (e.g., TFTs) control the brightness (transmissivity) of light through a pixel area and, for color displays, three colors (e.g., R (Red), G (Green), and B (Blue)) can be formed through a pixel array with a color filter arrangement, such as that shown in FIG. 2.

The TFT-LCD 100 includes gate drivers 120 for driving a plurality of gate lines arranged horizontally and source drivers 130 for driving a plurality of source lines arranged vertically. The source and gate lines are arranged on the LCD panel 110. The gate and source drivers 120 and 130 are controlled by a controller (not shown). Generally, the controller is provided outside the LCD panel 110. The gate and source drivers 120 and 130 are generally located outside the LCD panel 110, however, they can be located on the LCD panel 110 in a COG (Chip On Glass) display.

FIG. 3 is a block diagram of a conventional source driver 130. Referring to FIG. 3, the conventional source driver 130 includes a plurality of gamma decoders 131 and buffers 132. Each gamma decoder 131 receives n bits of image data (n=6, 8, 10, . . . ), and selects and outputs an analog voltage corresponding to a digital value of the image data among 2 n analog gray voltages. The image data is digital data obtained by processing a three-color signal (e.g., RGB digital data) transmitted from an external source such as a graphics card in the controller according to a resolution of the LCD panel 110. Analog image signals output from the gamma decoders 131 are buffered by the corresponding buffers 132 and respectively output to source lines S1, S2, S3, S4, etc. The analog image signals output from the buffers 132 quickly charge the source lines S1, S2, S3, S4, etc. and corresponding pixels on the LCD panel 110. Liquid crystal molecules of the pixels receiving the image signals are re-arranged in proportion to applied gray voltages, and thereby control the brightness of light transmitted therethrough.

To enhance color reproducibility by increasing the number of bits of R, G, and B image data, the area of a gamma decoder circuit used to decode the bits can increase in proportion to the increased number of bits. To avoid such increase in circuit complexity, an amplifier interpolation scheme has been developed. According to one such amplifier interpolation scheme, representative gray voltages are selected based on upper bits of digital image data and intermediate values are created from the selected representative gray voltages based on the remaining lower bits. The amplifier interpolation scheme can use a half method capable of reducing the gamma decoder circuit area by ½ or a quarter method capable of reducing the area by ¾. In the half method, intermediate interpolated voltages are created from representative gray voltages selected based on the upper bits of input image data. In the quarter method, interpolated voltages with ¼ the interval of representative gray voltages selected based on the upper bits of input image data are created.

This conventional amplifier interpolation scheme depends on input voltages of an amplifier used for interpolation. Interpolation of the voltages can become skewed if differences between input voltages of the amplifier are not small or if the differences are not equal for all gray levels. Accordingly, a source driver that uses the conventional interpolation scheme may not create interpolated voltages that enable generation of stable and uniformly distributed gray level differences.

SUMMARY OF THE INVENTION

Some embodiments of the present invention provide a source driver that responds to image data by generating an output signal which can be used to drive a flat panel display. The source driver includes a gamma decoder and an amplifier. The gamma decoder is configured to select one of a plurality of first analog gray voltages as a first voltage based on some upper bits of the image data, to select one of a plurality of second analog gray voltages as a second voltage based on other upper bits of the image data, and to selectively output at least one of the first voltage and the second voltage as a plurality of distributed analog signals in response to lower bits of the image data. The amplifier is configured to interpolate between the distributed analog signals from the gamma decoder to generate the output signal of the source driver. The amplifier includes a plurality of bias circuits and a plurality of MOSFETs. The bias circuits are each configured to generate a bias current. Each of the MOSFETs includes a source, a drain, and a gate terminal. The gate terminal of each of the MOSFETS is separately connected to receive a different one of the distributed analog signals from the gamma decoder. One of the source and drain terminals of each of the MOSFETS is separately connected to a different one of the bias circuits to receive the bias current, and the other one of the source and drain terminals of each of the MOSFETS is connected together at an output node to generate an interpolated signal. The output signal is based on the interpolated signal.

In some further embodiments, the gamma decoder includes a gamma voltage generator and an amplifier input voltage selector. The gamma voltage generator is configured to generate the plurality of first analog gray voltages and the plurality of second analog gray voltages based on a number of different logic combinations of the upper bits of the image data. The amplifier input voltage selector is configured to select one of the plurality of first analog gray voltages as the first voltage in response to some upper bits of the image data, and to select one of the plurality of second analog gray voltages as the second voltage in response to other upper bits of the image data, and selectively outputs at least one of the first voltage and the second voltage as the plurality of distributed analog signals in response to the lower bits of the image data.

In some further embodiments, the amplifier input voltage selector includes a first level selector that is configured to select one of the plurality of first analog gray voltages as the first voltage in response to some of the upper bits of the image data. A second level selector is configured to select one of the plurality of second analog gray voltages as the second voltage in response to other of the upper bits of the image data. An output selector is configured to selectively output at least one of the first voltage and the second voltage as the plurality of distributed analog signals in response to the lower bits of the image data. The output selector can selectively output different combinations of the first and second voltages across the plurality of distributed analog signals in response to the lower bits of the image data.

In some further embodiments, the plurality of distributed analog signals can include first and second analog signals. The output selector can output the first voltage as both of the first and second analog signals in response to a first logical value of the lower two bits of the image data, output the first voltage as the first analog signal and output the second voltage as the second analog signal in response to a second logical value of the lower two bits of the image data, and output the second voltage as both of the first and second analog signals in response to a third logical value of the lower two bits of the image data.

In some further embodiments, the plurality of distributed analog signals can include first, second, third, and fourth analog signals. The output selector can output the first voltage as each of the first, second, third, and fourth analog signals in response to a first logical value of the lower three bits of the image data, output the first voltage as the first, second, and third analog signals and output the second voltage as the fourth analog signal in response to a second logical value of the lower three bits of the image data, output the first voltage as the first and second analog signals and output the second voltage as the third and fourth analog signals in response to a third logical value of the lower three bits of the image data, output the first voltage as the first analog signal and output the second voltage as the second, third and fourth analog signals in response to a fourth logical value of the lower three bits of the image data, and output the second voltage as each of the first, second, third and fourth analog signals in response to a fifth logical value of the lower three bits of the image data.

In some further embodiments, magnitudes of numbered ones of the second analog gray voltages are between magnitudes of adjacent numbered ones of the first analog gray voltages.

In some further embodiments, the amplifier interpolates between the distributed analog signals from the gamma decoder to generate as the output signal a voltage with a level that corresponds to one of the first voltage, an average of the first and second voltage, and the second voltage. The amplifier may interpolate between the distributed analog signals from the gamma decoder to generate as the output signal a voltage with a level that corresponds to one of V1, (3V1+V2)/4, (V1+V2)/2, (V1+3V2)/4, and V2, where V1 is the first voltage and V2 is the second voltage.

Some other embodiments provide a method of driving a flat panel display device responsive to image data. First analog gray voltages are generated based on a number of different logic combinations of upper bits of the image data. Second analog gray voltages are generated based on the number of different logic combinations of the upper bits of the image data. One of the first analog gray voltages is selected as a first voltage based on some upper bits of the image data. One of the second analog gray voltages is selected as a second voltage based on other upper bits of the image data. At least one of the first voltage and the second voltage is selectively outputted as a plurality of distributed analog signals in response to lower bits of the image data. A plurality of separate bias currents are generated, and interpolation between the distributed analog signals is carried out using the separate bias currents to generate the output signal of the source driver.

DETAILED DESCRIPTION OF EMBODIMENTS OF THE INVENTION

Figure 1:
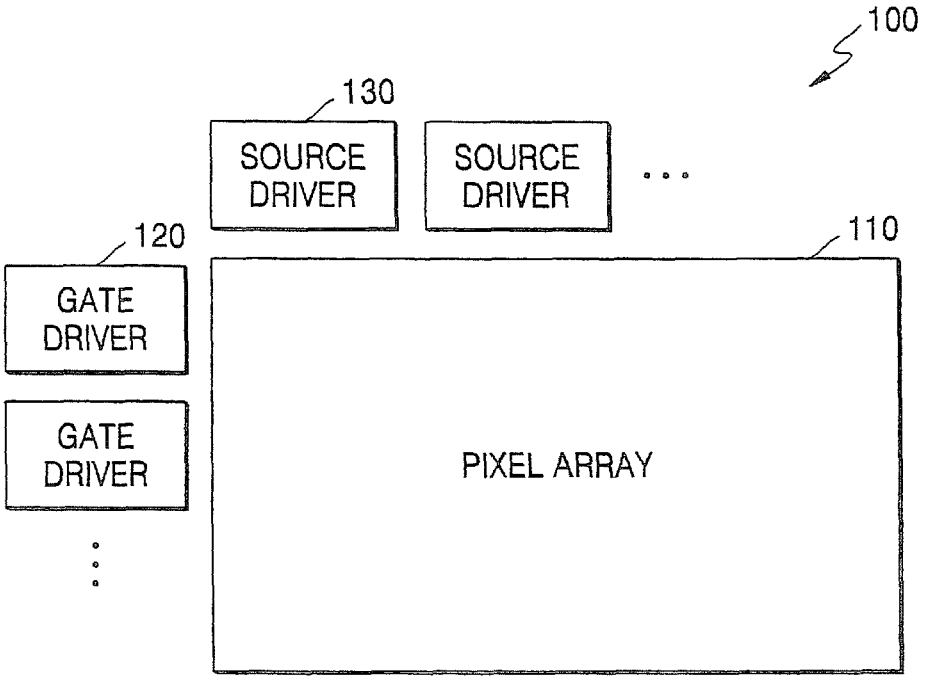
FIG. 1 (PRIOR ART)
FIG. 1 is a block diagram of a conventional TFT-LCD that includes a TFT-LCD panel and peripheral circuits.
Figure 2:
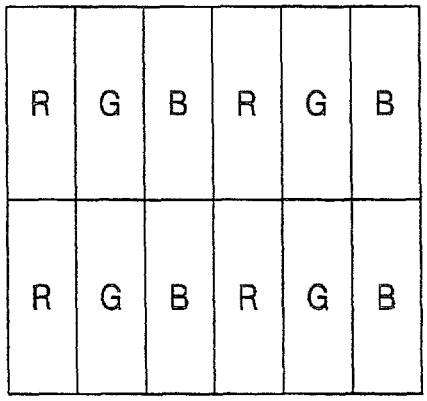
FIG. 2 (PRIOR ART)
FIG. 2 shows a conventional pixel structure.
Figure 3:
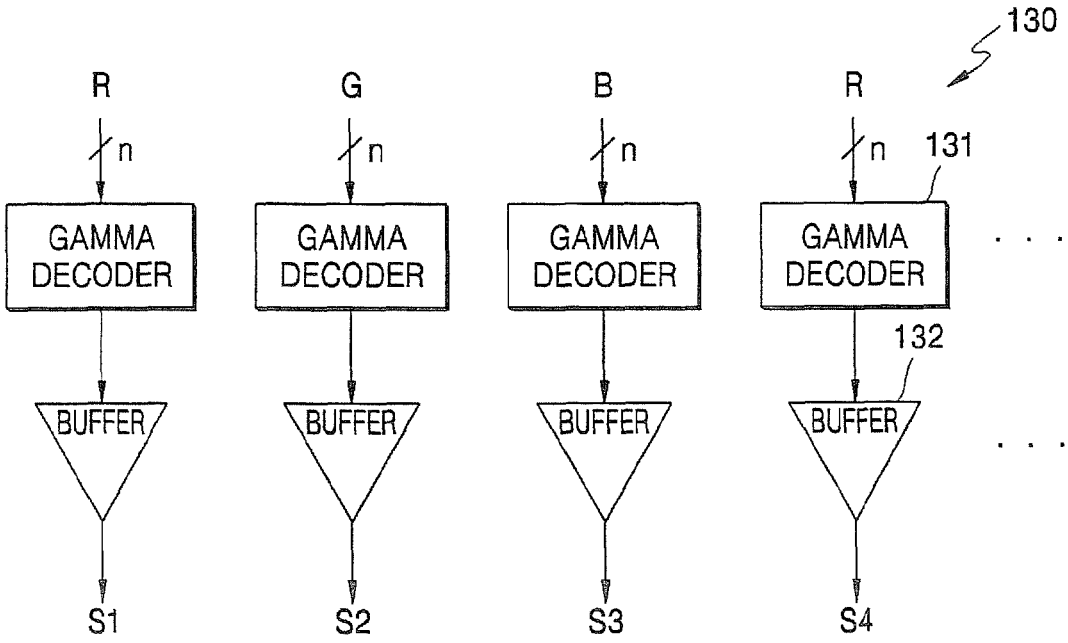
FIG. 3 (PRIOR ART)
FIG. 3 is a block diagram of a conventional source driver.

While the invention is susceptible to various modifications and alternative forms, specific embodiments thereof are shown by way of example in the drawings and will be described in detail herein. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the drawings.

It will be understood that when an element or layer is referred to as being "on," "connected to," or "coupled to"

another element or layer, it can be directly on, connected, or coupled to the other element or layer or intervening elements or layers may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that although the terms first and second are used herein to describe various steps, operations, elements, and components, these steps, operations, elements, and components should not be limited by these terms. These terms are only used to distinguish one step, operation, element, or component from another step, operation, element, or component. Thus, a first step, operation, element, or component discussed below could be termed a second step, operation, element, or component, and similarly, a second step, operation, element, or component may be termed a first step, operation, element, or component without departing from the teachings of the present invention.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 4:
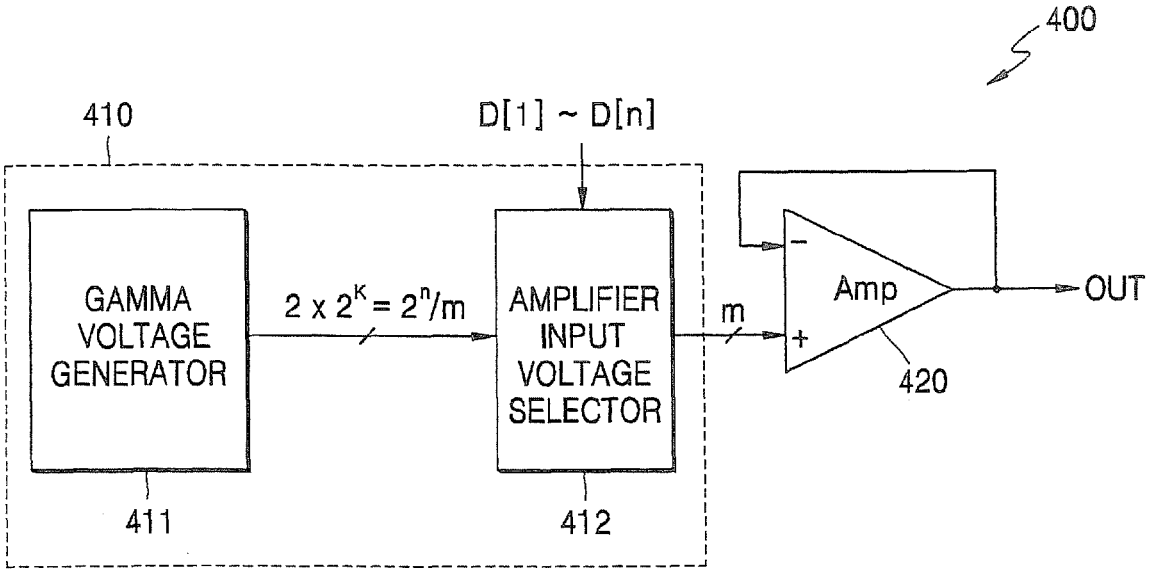
FIG. 4 is a block diagram of a source driver according to an embodiment of the present invention.

FIG. 4 is a block diagram of a source driver 400 according to embodiments of the present invention. Referring to FIG. 4, the source driver 400 includes a gamma decoder 410 and an amplifier 420. In FIG. 4, a single unit for driving a single source line is shown, however, it is also possible to configure a plurality of units corresponding to a plurality of source lines.

The gamma decoder 410 receives n bits of image data D[1] through D[n] (n=6, 8, 10, . . . ) and generates m distributed analog outputs. The image data D[1] through D[n] is digital data obtained by processing digital data of a three-color signal (that is, R (Red), G (Green), or B (Blue)) transmitted from an external source such as a graphic card in a controller (not shown) according to a resolution of a LCD panel. The amplifier 420 receives the m distributed analog outputs and generates corresponding analog interpolated voltages OUT. That is, if the gamma decoder 410 generates m different distributed outputs, the amplifier 420 generates interpolated voltages OUT corresponding to the m different distributed outputs. The interpolated voltages OUT output from the amplifier 420 drive source lines and liquid crystal polymers of pixels receiving the interpolated voltages OUT are re-arranged in proportion to corresponding gray voltages, thereby controlling the transmittance of light.

In FIG. 4, the gamma decoder 410 includes a gamma voltage generator 411 and an amplifier input voltage selector 412. The gamma voltage generator 411 generates first analog gray voltages and second analog gray voltages. The number of generated first analog gray voltages can be equal to the number (2 k) of logic combinations capable of being created using the upper bits of the input image data D[1] through D[n]. The number of the second analog gray voltages can also be equal to the number (2 k) of logic combinations of the upper bits.

The amplifier input voltage selector 412 selects a voltage corresponding to a digital value of the upper bits from the first analog gray voltages and a voltage corresponding to a digital value of the upper bits from the second analog gray voltages. The amplifier input voltage selector 412 selectively outputs at least one of the two selected voltages as the m distributed outputs according to the logic values represented by the remaining lower bits of the input image data D[1] through D[n]. The amplifier input voltage selector 412 will be described in more detail with reference to FIGS. 5 and 8.

In the source driver 400, which processes the image data D[1] through D[n], the gamma decoder 410 generates 2×2 k analog gray voltages instead of 2 n analog gray voltages, where k is the number of the predetermined upper bits of the image data D[1] through D[n] and 2×2 k is less than 2 n. When the amplifier input voltage selector 412 generates the m distributed outputs, the total number of the analog gray voltages generated by the gamma decoder 410 is equal to 2×2 k=2 n/m. For example, if input image data has n=10 and the number of the input image data is k=7, the gamma voltage generator 411 generates 2×27 (256) analog gray voltages and the amplifier input voltage selector 412 generates four distributed outputs corresponding to logic combinations of the remaining 3 lower bits. That is, two of the analog gray voltages generated by the gamma voltage generator 411 are selected as representative analog voltages based on the upper bits, and four outputs distributed by the amplifier input voltage selector 412 are interpolated by the amplifier 420 so that voltages with magnitudes between the representative analog voltages can be generated. The amplifier input voltage selector 412, as will be described later with reference to FIG. 5, can generate five voltages using the four distributed outputs and, accordingly, the amplifier 420 generates five interpolated voltages OUT corresponding to the five voltages. Therefore, the number of the interpolated voltages OUT generated by the amplifier 420 is 210, and, accordingly, 1024 grays can be displayed by each pixel of the LCD panel.

By using the interpolation scheme, it may be possible to reduce the number of gates required for a gamma decoder, thus minimizing a circuit area, and to reduce the number of analog gray voltages to be generated by a gamma voltage generator.

Figure 5:
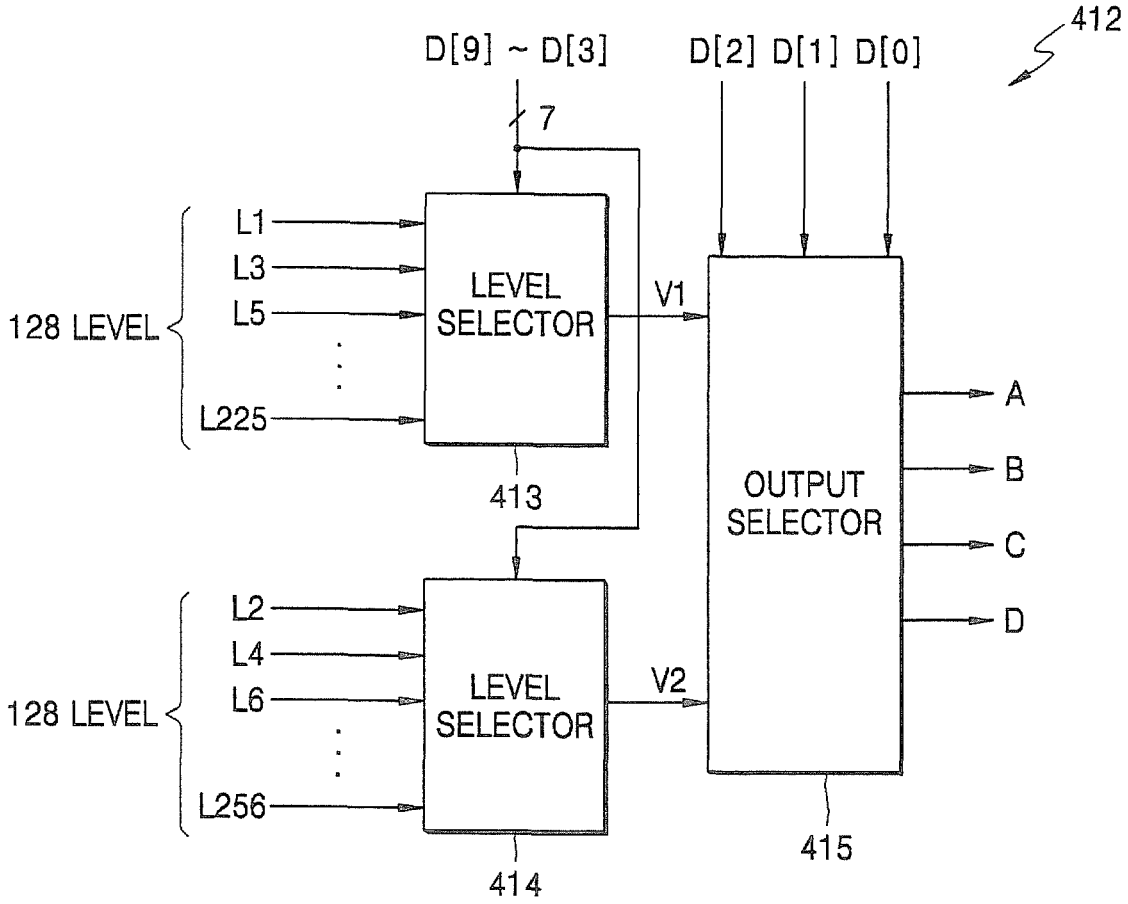
FIG. 5 is a block diagram of an amplifier input voltage selector of FIG. 4 according to a first embodiment of the present invention.

FIG. 5 is a block diagram of the amplifier input voltage selector 412 of FIG. 4 according to a first embodiment of the present invention. The amplifier input voltage selector 412 selects two voltages V1 and V2 among 2×128 analog gray voltages L1 through L256 generated by the gamma voltage generator 411 using the upper 7 bits D[3] through D[9] and the lower 3 bits D[0] through D[2] of 10 bits of input image data D[0] through D[9], and selectively outputs at least one of the two selected voltages V1 and V2 as the four distributed outputs A, B, C, and D according to the logic values represented by the lower 3 bits D[0] through D[2] of the input image data. Referring to FIG. 5, the amplifier input voltage selector 412 includes a first level selector 413, a second level selector 414, and an output selector 415.

The first level selector 413 selects one of first analog gray voltages L1, L3, L5, . . . , L255 generated by the gamma voltage generator 411 corresponding to a digital value of the upper 7 bits D[3] through D[9], and outputs the selected gray voltage as a first voltage V1. The second level selector 414 selects one of second analog gray voltages L2, L4, L6, . . . , L256 generated by the gamma voltage generator 411 corresponding to a digital value of the upper 7 bits D[3] through D[9], and outputs the selected gray voltage as a second voltage V2. Each of the second analog gray voltages L2, L4, L6, . . . , L256 is an analog voltage with a magnitude between any two of the first analog gray voltages L1, L3, L5, . . . , L255. The analog gray voltages L1 through L256 sequentially increase.

Figures 6, 7:
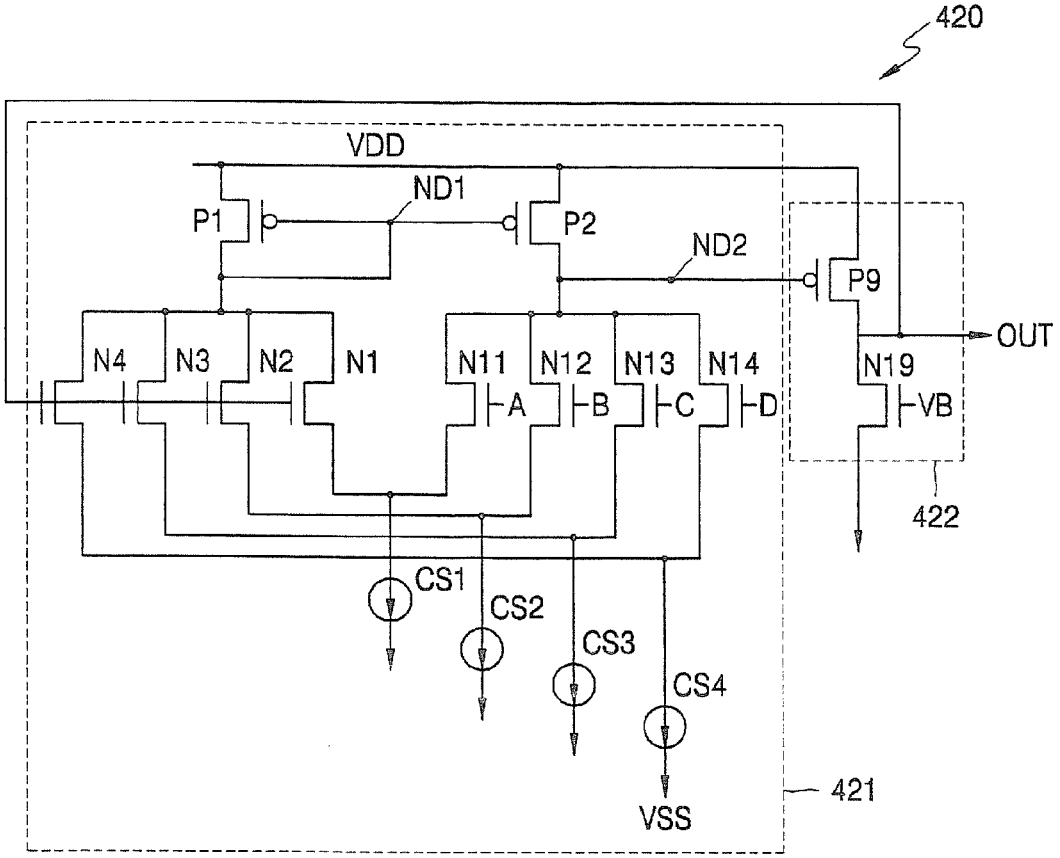
FIG. 6 is a circuit diagram of an amplifier of FIG. 4 according to the first embodiment of the present invention.
FIG. 7 is a table of input/output signals of the amplifier of FIG. 6 according to some embodiments of the present invention.

The output selector 415 selectively outputs (distributes) at least one of the first voltage V1 and the second voltage V2 as the four distributed outputs A, B, C, and D in response to the lower 3 bits D[0] through D[2]. Five combinations of the four distributed outputs A, B, C, and D can be generated according to five logic combinations of the lower 3 bits D[0] through D[2], as shown in FIG. 7. Logic combinations other than these five logic combinations are not used. For example, if a digital value of the lower 3 bits is "000", the output selector 415 outputs "V1, V1, V1, V1" as the four distributed outputs A, B, C, and D. If a digital value of the lower 3 bits D[0] through D[2] is "001", the output selector 415 outputs "V1, V1, V1, V2" as the four distributed outputs A, B, C, and D. If a digital value of the lower 3 bits D[0] through D[2] is "010", the output selector 415 outputs "V1, V1, V2, V2" as the four distributed outputs A, B, C, and D. If a digital value of the lower 3 bits D[0] through D[2] is "011", the output selector 415 outputs "V1, V2, V2, V2" as the four distributed outputs A, B, C, and D. If a digital value of the lower 3 bits D[0] through D[2] is "100", the output selector 415 outputs "V2, V2, V2, V2" as the four distributed outputs A, B, C, and D. That is, the output selector 415 repeatedly combines the first voltage V1 and the second voltage V2 in an adverse direction, within the four distributed outputs A, B, C, and D.

FIG. 6 is a circuit diagram of the amplifier 420 of FIG. 4 according to the first embodiment of the present invention. Referring to FIG. 6, the amplifier 420 includes an amplification circuit 421 with a differential amplifier structure and a buffering circuit 422.

The amplification circuit 421 includes a first p-type Metal-Oxide-Semiconductor Field Effect Transistor (MOSFET) P1, a second p-type MOSFET P2, third n-type MOSFETs N1 through N4, fourth n-type MOSFETs N11 through N14, and bias circuits CS1 through CS4.

The first p-type MOSFET P1 has a gate terminal connected to a first node N1, and source and drain terminals, one of which is connected to a first supply voltage VDD, and the other of which is connected to the first node ND1. The second MOSFET P2 has a gate terminal connected to the first node ND1, and source and drain terminals, one which is connected to the first supply voltage VDD, and the other of which is connected to the output node ND2.

The gate terminals of the third n-type MOSFETs N1 through N4 receive a buffered signal transmitted from the buffering circuit 422 via the output node N2, the drain terminals thereof are connected to the first node ND1, and the source terminals thereof are respectively connected to the bias circuits CS1 through CS4. The bias circuits CS1 through CS4 are formed by applying a predetermined voltage to the gate terminals of the third n-type MOSFETs, N1 through N4, and act as voltage controlled-current sources for controlling current flowing through a second power supply VSS.

The gate terminals of the fourth n-type MOSFETs N11 through N14 receive the outputs A, B, C, and D generated by the amplifier input voltage selector 412, the drain terminals thereof are respectively connected to the output node ND2, and the source terminals thereof are connected to the source terminals of the third n-type MOSFETs N1 through N4. That is, the source terminals of the fourth n-type MOSFETs N11 through N14 are not connected to each other. Accordingly, the bias circuits CS1 through CS4 respectively connected to the source terminals of the fourth n-type MOSFETs N11 through N14 receiving the distributed outputs A, B, C, and D operate independently, so that changes in a voltage applied to each source terminal of the fourth n-type MOSFETs N11 through N14 do not influence other MOSFETs.

The buffering circuit 422 buffers a signal of the output node ND2 using a p-type MOSFET P9 and an n-type MOSFET N19 and outputs the buffered signal as an interpolated voltage OUT to the gate terminals of the third n-type MOSFETs N1 through N4. The gate terminal of the MOSFET N19 is biased at a predetermined voltage VB, like the bias circuits CS1 through CS4.

By the above-described operations of the amplifier 420, as shown in FIG. 7, V1, (3V1+V2)/2, (V1+3V2)/4, and V2 can be generated as the interpolated voltages OUT according to a digital value of the lower 3 bits D[0] through D[2], using the voltages V1 and V2 selected by the amplifier input voltage selector 412

Figure 8:
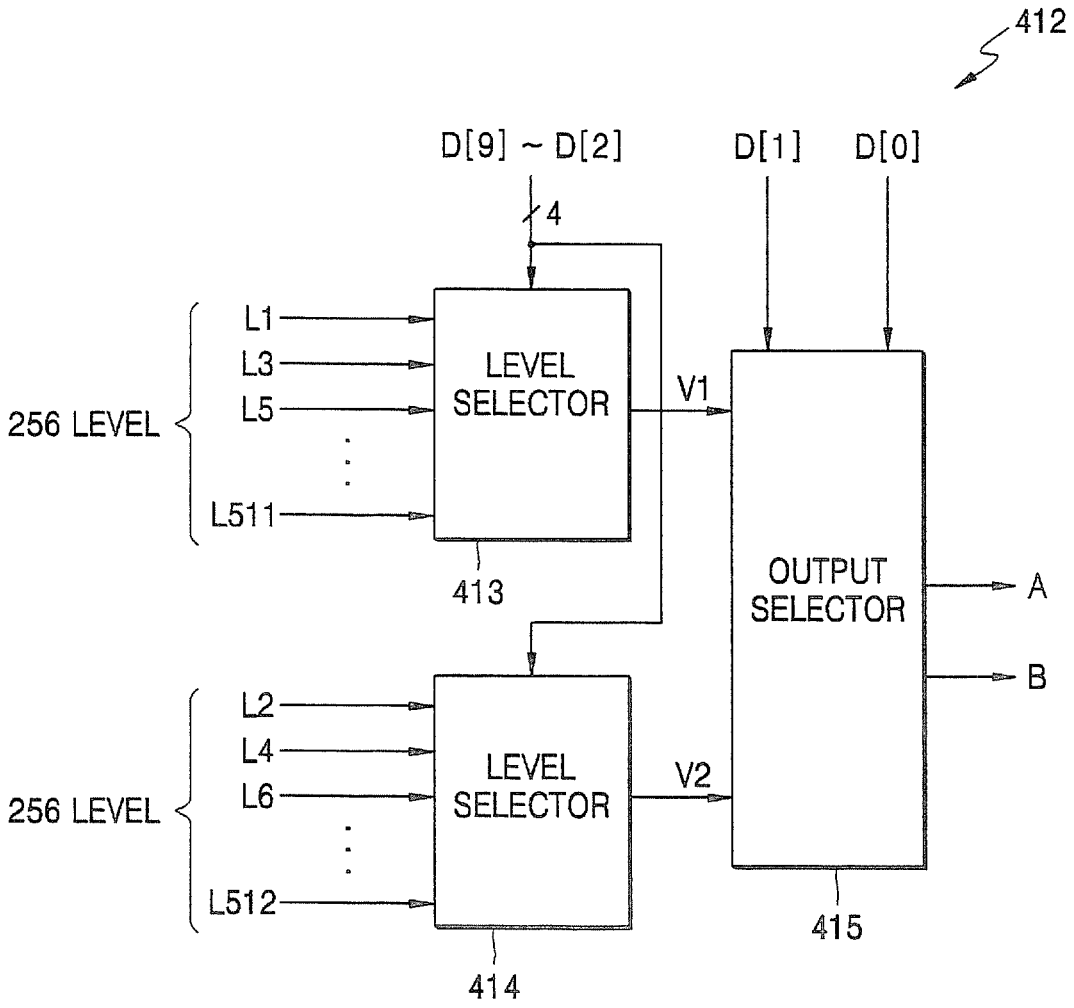
FIG. 8 is a block diagram of an amplifier input voltage selector of FIG. 4 according to a second embodiment of the present invention.

FIG. 8 is a block diagram of the amplifier input voltage selector 412 according to a second embodiment of the present invention, in which two voltages V1 and V2 among 2×256 analog gray voltages L1 through L512 generated by the gamma voltage generator 411 are selected using the upper 8 bits D[2] through D[9] and the lower 2 bits D[0] through D[9] of the 10 bits of the input image data D[0] through D[9]. The amplifier voltage selector selectively outputs at least one of the selected two voltages V1 and V2 as two distributed outputs A and B. Referring to FIG. 8, the amplifier input voltage selector 412 includes a first level selector 413, a second level selector 414, and an output selector 415.

The first level selector 413 selects a gray voltage corresponding to a digital value of the upper 8 bits D[2] through D[9] from the first analog gray voltages L1, L3, L5, . . . , L511 generated by the gamma voltage generator 411, and outputs the selected gray voltage as a first voltage V1. The second level selector 414 selects a gray voltage corresponding to a digital value of the upper 8 bits D[2] through D[9] from the second analog gray voltage L2, L4, L6, . . . , L512 generated by the gamma voltage generator 411, and outputs the selected gray voltage as a second voltage V2. Each of the second analog gray voltages L2, L4, L6, . . . , L512 is an analog voltage with a magnitude between any two of the first analog gray voltages L1, L3, L5, . . . , L511.

Figures 9, 10:
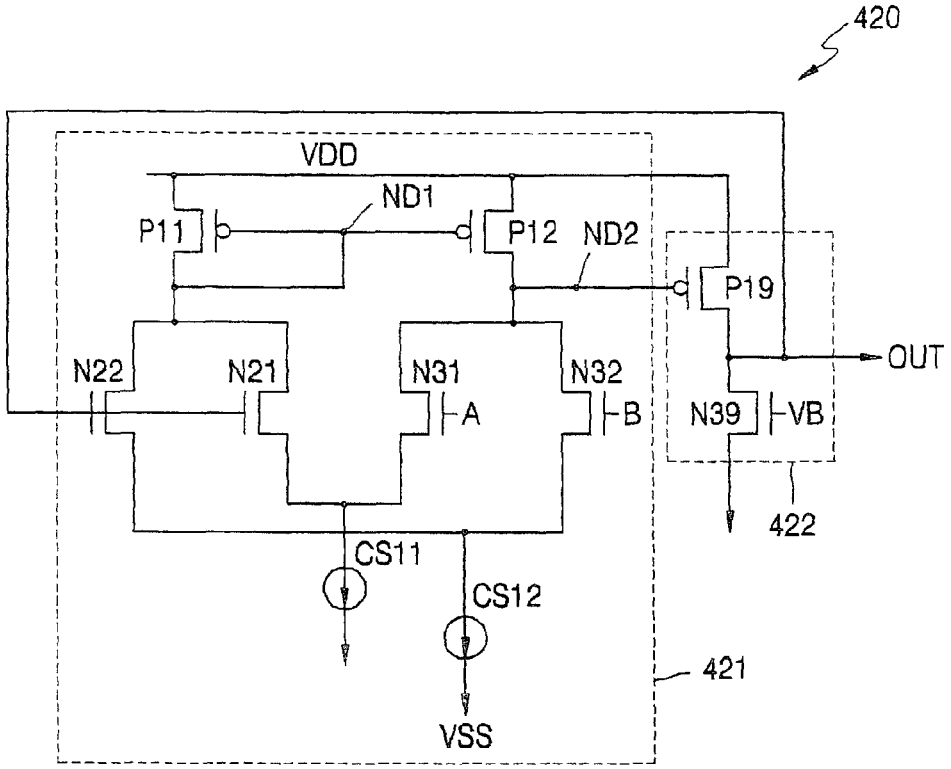
FIG. 9 is a circuit diagram of an amplifier of FIG. 4 according to the second embodiment of the present invention.
FIG. 10 is a table of input/output signals of the amplifier of FIG. 9 according to some embodiments of the present invention.

The output selector 415 selectively outputs the first voltage V1 and the second voltage V2 in response to the lower 2 bits D[0] and D[1] to generate the two distributed outputs A and B. Three combinations of the two distributed outputs A and B can be generated according to logic combinations of the lower 2 bits D[0] and D[1], as shown in FIG. 10. Logic combinations other than these three logic combinations are not used. For example, if a digital value of the lower 2 bits D[0] and D[1] is "00", the output selector 415 outputs "V1, V1" as the two distributed outputs A and B. If a digital value of the lower 2 bits D[0] and D[1] is "01", the output selector 415 outputs "V1, V2" as the two distributed outputs A and B. If a digital value of the lower 2 bits D[0]

and D[1] is "10", the output selector 415 outputs "V2, V2" as the two distributed outputs A and B. That is, the output selector 415 repeatedly combines the first voltage V1 and the second voltage V2 in an adverse direction, within the two distributed outputs A and B.

FIG. 9 is a circuit diagram of an amplifier 420 of FIG. 4 according to the second embodiment of the present invention. Referring to FIG. 9, the amplifier 420 includes an amplification circuit 421 with a differential amplifier structure and a buffering circuit 422. The amplification circuit 421 includes a first p-type MOSFET P11, a second p-type MOSFET P12, third n-type MOSFETs N21 and N22, fourth n-type MOSFETs N31 and N32, and bias circuits CS11 and CS12.

The first MOSFET P11 has a gate terminal connected to a first node ND1, and source and drain terminals, one of which is connected to a first supply voltage VDD, and the other of which is connected to the first node ND1. The second MOSFET P12 has a gate terminal connected to the first node ND1, and source and drain terminals, one of which is connected to the first supply voltage VDD, and the other of which is connected to an output node ND2. The gate terminals of the third n-type MOSFETs N21 and N22 receive a buffered signal transmitted from the buffering circuit 422 via the output node ND2, the drain terminals thereof are connected to the first node ND1, and the source terminals thereof are respectively connected to the bias circuits CS11 and CS12.

The gate terminals of the fourth n-type MOSFETs N31 and N32 receive the distributed outputs A and B from the amplifier input voltage selector 412, the drain terminals thereof are connected to the output node ND2, and the source terminals thereof are respectively connected to the source terminals of the third n-type MOSFETs N1 through N4. Accordingly, the bias circuits CS11 and CS12 connected to the source terminals of the MOSFETs N31 through N32 receiving the distributed outputs A and B operate independently so that voltage changes, etc. of the source terminal of one of the fourth n-type MOSFETs N31 and N32 do not influence the other n-type MOSFET N31 or N32.

The buffering circuit 422 buffers a signal of the output node ND2 using the p-type MOSFET P19 and an n-type MOSFET N39 and outputs the buffered signal as an interpolated voltage OUT to the gate terminals of the third n-type MOSFETs N21 and N22. The gate terminal of the n-type MOSFET N39 is biased at a predetermined voltage VB, like the bias circuits CS11 through CS12.

By the above-described operations of the amplifier 420, as shown in FIG. 10, V1, (V1+V2)/2, and V2 can be generated as the interpolated voltages OUT according to digital values of the lower 2 bits D[0] and D[1], using the first and second voltages V1 and V2 selected by the amplifier input voltage selector 412.

As described above, in a source driver 400 for driving a flat panel display device according some embodiments of the present invention, a first level selector 413 and a second level selector 414 select a first voltage V1 and a second voltage V2 from gray voltages generated by a gamma voltage generator 411, respectively, using predetermined upper bits of input image data D[1] through D[n], and an output selector 415 selectively distributes the first voltage V1 and the second voltage V2 according to the remaining lower bits, thus outputting a plurality of distributed outputs (A, B, . . . ). Accordingly, an amplifier 420 may generate uniformly distributed interpolated voltages OUT according to the distributed outputs (A, B, . . . ) using an amplification circuit 421 with a differential amplifier structure in which bias circuits (CS1, CS2, . . . ) respectively connected to source terminals of MOSFETs receiving the distributed outputs (A, B, . . . ) operate independently.

As described above, in a source driver for driving a flat panel display device, according some embodiments of the present invention, by using an interpolation scheme capable of independently operating amplifier input MOSFETs, it may be possible to remove interference between source voltages of the amplifier input MOSFETs, thereby generating uniformly distributed interpolated voltages in response to various amplifier inputs. Therefore, it may also be possible to reduce the number of gates included in gamma decoders, thereby reducing an area required for a source driver integrated circuit chip while possibly enabling the development of higher quality displays.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A display driver, comprising:

a voltage source having a plurality of voltage outputs distributed in magnitude, a selection circuit having a first output of a first voltage and a second output of a second voltage, the first and second voltages being two of the voltages output by the voltage source and selected in response to a first portion of display data received by the selection circuit; and an output selector circuit, receiving the first and second voltages as inputs, and having a number of x voltage outputs where x is an integer greater or equal to two, the x voltage outputs being a number of y first voltages and a number of x-y second voltages, where y is an integer greater or equal to zero determined in response to a second portion of display data received by output selector circuit;

and an amplifier including x first circuits, each first circuit having an input of a corresponding one of the x voltage outputs of the output selector circuit, each first circuit comprising:

a first nMOS transistor, a second nMOS transistor and a bias circuit, the first nMOS transistor having a gate connected to the input of the first circuit of the corresponding one of the x voltage outputs of the output selector, and having a source-channel-drain current path serially connected to the bias circuit, the second nMOS transistor having a source-channel-drain current path serially connected to the bias circuit;

wherein gates of the second nMOS transistors of the x first circuits are connected in common, a first node having connections to drains of the first nMOS transistors; and a second node having connections to drains of the second nMOS transistors of the first circuits; and a second circuit responsive to a voltage on the first node to output a voltage to drive a display panel.

2. The device of claim 1, where the second portion of display data may select x to be any integer from zero to x.

3. The device of claim 1, further comprising first and second pMOS transistors, gates of the first and second pMOS transistors and the source of the second pMOS transistor sharing a common node, the drain of the first pMOS transistor connected to the first node and the drain of the second pMOS transistor connected to the second node.

4. The device of claim 3, wherein the sources of the first and second pMOS transistors are connected to a supply voltage.

5. The display driver of claim 1, wherein each bias circuit is directly connected to ground.

6. The display driver of claim 1, wherein the source of each first nMOS transistor is directly connected to the corresponding bias circuit.

7. The display driver of claim 1, wherein each bias circuit is a current source.

8. The display driver of claim 1, wherein the display driver is a source driver IC.

9. A method of driving a display panel, receiving image data representing a pixel gray scale;

generating a plurality of gray voltages having different magnitudes;

selecting a first voltage and a second voltage of the plurality of gray voltages in response to a first portion of the image data;

in response to a second portion of the image data, outputting x output voltages where x is an integer greater or equal to two, the x output voltages being y first voltages and x-y second voltages, where y is an integer greater or equal to zero, interpolating the x output voltages by providing each of the x output voltages to a corresponding one of x first circuits, each first circuit comprising a first nMOS transistor, a second nMOS transistor and a bias circuit, the first nMOS transistor having a gate connected to the input of the first circuit, and having a source-channel-drain current path connected to the bias circuit, the second nMOS transistor having a source-channel-drain current path connected to the bias circuit;

and providing an interpolated voltage on a node connected to each first circuit; and driving a display panel with a voltage having a magnitude correlating to the interpolated voltage on the node.

10. The method of claim 9, wherein gates of the second nMOS transistors of the x first circuits are connected in common, wherein drains of the second nMOS transistors of the x first circuits are connected in common, and wherein drains of the first nMOS transistors of the x first circuits are connected in common at the node.

11. The method of claim 9, wherein the selecting of the first voltage and the second voltage of the plurality of gray voltages is performed by a gamma decoder.

12. A method of driving a display panel, comprising:

receiving image data for a pixel of a display;

selecting first and second voltages of a plurality of sequentially increasing voltages, the selection being responsive to the image data, the first voltage and the second voltage being different from each other;

generating a third voltage corresponding to an average of x first voltages and y second voltages, x and y being integers equal to or greater than one, the third voltage generated by applying a voltage corresponding to the first voltage to gates of x nMOS transistors, and by applying a voltage corresponding to the second voltage to gates of y nMOS transistors, each of the x nMOS transistors and y nMOS transistors connected to a respective separate bias circuit that is not connected to any of the others of the x nMOS transistors and y nMOS transistors;

determining x and y in response to the image data;

providing a fourth voltage corresponding to the third voltage to a display panel to drive the pixel.

13. The method of claim 12, wherein the sum of x and y equals a constant for different image data.

14. The method of claim 13, wherein the image data has sufficient information to select any integer between zero and the constant for x and for y in the determining step.

15. The method of claim 12, wherein each bias circuit is connected directly to ground.

16. The method of claim 12, wherein each bias circuit is a current source.

17. The method of claim 12, wherein the selecting of the first and second voltages is performed by a gamma decoder.

18. The method of claim 12, wherein each of the x nMOS transistors and y nMOS transistors include a drain, the drains of the x nMOS transistors and y nMOS transistors being connected together.

19. A display system comprising:

a display panel comprising a plurality of pixels;

a plurality of source conducting lines to transmit a gray voltage corresponding to a brightness value to drive a pixel;

a plurality of source voltage drivers, each connected to a corresponding source conducting lines, each comprising:

a voltage source having a plurality of voltage outputs distributed in magnitude, a selection circuit having a first output of a first voltage and a second output of a second voltage, the first and second voltages being two of the voltages output by the voltage source and selected in response to a first portion of display data received by the selection circuit; and an output selector circuit, receiving the first and second voltages as inputs, and having a number of x voltage outputs where x is an integer greater or equal to two, the x voltage outputs being a number of y first voltages and a number of x-y second voltages, where y is an integer greater or equal to zero determined in response to a second portion of display data received by output selector circuit;

and an amplifier including x first circuits, each first circuit having an input of a corresponding one of the x voltage outputs of the output selector circuit, each first circuit comprising:

a first nMOS transistor, a second nMOS transistor and a bias circuit, the first nMOS transistor having a gate connected to the input of the first circuit of the corresponding one of the x voltage outputs of the output selector, and having a source-channel-drain current path serially connected to the bias circuit, the second nMOS transistor having a source-channel-drain current path serially connected to the bias circuit;

a conductor to connect gates of the second nMOS transistors in common;

a first node having connections to drains of the first nMOS transistors; and a second node having connections to drains of the second nMOS transistors of the first circuits; and a second circuit responsive to a voltage on the first node to output a voltage on the corresponding source conducting lines to drive the display panel.

20. The system of claim 19, where the second portion of display data may select x to be any integer from zero to x.

21. The system of claim 19, further comprising first and second pMOS transistors, gates of the first and second pMOS transistors and the source of the second pMOS transistor sharing a common node, the drain of the first pMOS transistor connected to the first node and the drain of the second pMOS transistor connected to the second node.

22. The system of claim 21, wherein the sources of the first and second pMOS transistors are connected to a supply voltage.

23. The system of claim 19, wherein each bias circuit is directly connected to ground.

24. The system of claim 19, wherein the source of each first nMOS transistor is directly connected to the corresponding bias circuit.

25. The system of claim 19, wherein each bias circuit is a current source.

26. The system of claim 19, further comprising a gamma decoder, wherein the selection circuit is an element of the gamma decoder.

27. A display comprising:

a display panel comprising a plurality of pixels;

a plurality of conducting lines to transmit a gray voltage image signal corresponding to a brightness value to drive a pixel;

a plurality of display drivers, each connected to a corresponding conducting line, each display driver comprising a gamma decoder to generate at least four analog gray voltages and an amplifier to receive the at least four analog gray voltages generated by the gamma decoder and to output an analog output voltage corresponding to the gray voltage image signal transmitted by the corresponding conducting line, each gamma decoder comprising:

a voltage source having a plurality of voltage outputs distributed in magnitude, a selection circuit having a first output of a first voltage and a second output of a second voltage, the first and second voltages being two of the voltages output by the voltage source and selected in response to a first portion of display data received by the selection circuit; and an output selector circuit, receiving the first and second voltages as inputs, and having at least four voltage outputs including a number of y first voltages and a number of four minus y second voltages, where y is an integer greater or equal to zero determined in response to a second portion of display data received by output selector circuit;

each amplifier comprising:

at least four first circuits, each first circuit having an input of a corresponding one of the four voltage outputs of the output selector circuit, each first circuit comprising:

a first nMOS transistor, a second nMOS transistor and a bias circuit, the first nMOS transistor having a gate connected to the input of the first circuit of the corresponding one of the four voltage outputs of the output selector, and having a source-channel-drain current path connected to the bias circuit, the second nMOS transistor having a source-channel-drain current path connected to the bias circuit;

a conductor to connect gates of the second nMOS transistors in common;

a first node having connections to drains of the first nMOS transistors; and a second node having connections to drains of the second nMOS transistors of the first circuits; and a second circuit responsive to a voltage on the first node to output a voltage on the corresponding conducting lines to drive the display panel.

28. The display of claim 27, further comprising:

gate lines and source lines arranged on the display panel, wherein the plurality of conducting lines are the source lines and the each of the display drivers is a source driver.

29. The display of claim 28, wherein the source lines connect to transistors which connect to pixel electrodes.

30. The display of claim 29, wherein the display is a liquid crystal display comprising a liquid crystal layer disposed between an upper plate and a lower plate, wherein the transistors are thin film transistors and connect to electrodes to re-arrange liquid crystal polymers in the liquid crystal layer to cause a gray level corresponding to the voltage provided on the corresponding source conducting line.

31. The display of claim 28, wherein the source driver is located adjacent to the display panel.

32. The display of claim 28, wherein the source driver is located on the display panel.

33. The display of claim 32, wherein the source driver is located in a chip.

34. The display of claim 28, wherein the display panel is a panel of one of the group consisting of: thin film transistor liquid crystal display, electro luminance display, super twisted nematic liquid crystal display and plasma display panel.

35. A display driver comprising:

a gamma decoder to generate at least four analog gray voltages; and an amplifier to receive the at least four analog gray voltages generated by the gamma decoder and to output an image signal voltage;

wherein each gamma decoder comprises:

a voltage source having a plurality of voltage outputs distributed in magnitude, a selection circuit having a first output of a first voltage and a second output of a second voltage, the first and second voltages being two of the voltages output by the voltage source and selected in response to a first portion of display data received by the selection circuit; and an output selector circuit, receiving the first and second voltages as inputs, and having at least four voltage outputs including a number of y first voltages and a number of four minus y second voltages, where y is an integer greater or equal to zero determined in response to a second portion of display data received by output selector circuit;

wherein each amplifier comprises:

at least four first circuits, each first circuit having an input of a corresponding one of the at least four voltage outputs of the output selector circuit, each first circuit comprising:

a first nMOS transistor, a second nMOS transistor and a bias circuit, the first nMOS transistor having a gate connected to the input of the first circuit of the corresponding one of the four voltage outputs of the output selector, and having a source-channel-drain current path connected to the bias circuit, the second nMOS transistor having a source-channel-drain current path connected to the bias circuit;

a conductor to connect gates of the second nMOS transistors in common;

a first node having connections to drains of the first nMOS transistors; and a second node having connections to drains of the second nMOS transistors of the first circuits; and a second circuit responsive to a voltage on the first node to output the image signal voltage.

36. The display driver of claim 35, wherein the display driver is a source driver located in a chip.

* * * * *